US008727031B2

(12) United States Patent
Eberlein et al.

(10) Patent No.: US 8,727,031 B2
(45) Date of Patent: May 20, 2014

(54) SYSTEM AND METHOD FOR PREVENTING OR EXTINGUISHING FIRE

(75) Inventors: Anselm Eberlein, Hannover (DE); Peter Uwe Kersten, Wietze (DE)

(73) Assignee: Amrona AG, Zug (CH)

( * ) Notice: Subject to any disclaimer, the term of this patent is extended or adjusted under 35 U.S.C. 154(b) by 430 days.

(21) Appl. No.: 12/637,599

(22) Filed: Dec. 14, 2009

(65) Prior Publication Data

US 2010/0155088 A1 Jun. 24, 2010

(30) Foreign Application Priority Data

Dec. 12, 2008 (EP) ..... 08171495

(51) Int. Cl.
*A62C 35/00* (2006.01)
*A62C 2/00* (2006.01)
*A62C 3/00* (2006.01)

(52) U.S. Cl.
USPC ..... 169/45; 169/11; 169/43; 169/46

(58) Field of Classification Search
USPC ..... 169/11, 46, 43, 44, 45
See application file for complete search history.

(56) References Cited

U.S. PATENT DOCUMENTS

| | | | | |
|---|---|---|---|---|
| 2008/0135265 | A1* | 6/2008 | Wagner et al. | 169/45 |
| 2008/0156505 | A1 | 7/2008 | Wagner | 169/11 |
| 2008/0156506 | A1* | 7/2008 | Wagner et al. | 169/11 |
| 2009/0038810 | A1* | 2/2009 | Wagner | 169/45 |
| 2009/0038811 | A1* | 2/2009 | Wagner | 169/46 |

FOREIGN PATENT DOCUMENTS

| | | |
|---|---|---|
| CN | 1431027 | 7/2003 |
| CN | 1533814 | 10/2004 |
| DE | 10249126 | 6/2004 |
| EP | 1913980 | 4/2008 |
| JP | 11226340 | 8/1999 |
| JP | 2000-102717 | 4/2000 |
| JP | 2010-263109 | 11/2010 |
| RU | 2126282 | 2/1999 |
| WO | WO94/08659 | 4/1994 |

OTHER PUBLICATIONS

European Search Report, dated May 28, 2009, from related European Application No. 08171495.8.
Office Action dated Sep. 10, 2013, from related Japanese Application No. 2011-540119, with English translation.

* cited by examiner

*Primary Examiner* — Justin Jonaitis
(74) *Attorney, Agent, or Firm* — Greenberg Traurig, LLP

(57) ABSTRACT

Described herein are an inerting method as well as an inerting system (1) for preventing and/or extinguishing fire, wherein a gas separation system (3, 4) is provided to set and/or maintain a predefinable oxygen content, which is reduced compared to normal ambient air, in the spatial atmosphere of an enclosed room (2), said system separating off at least a portion of the oxygen contained in an initial nitrogen/oxygen gas mixture and thereby provide a nitrogenated gas mixture at the outlet (4*a*) of the gas separation system (3, 4). In order to achieve the setting and maintaining of a predefined inerting level with the lowest possible expenditure of energy, the description herein provides for a control device (5) designed to control the gas separation system (3, 4) such that the residual oxygen content of the nitrogenated gas mixture is changed as a function of the oxygen content prevailing at that moment in the spatial atmosphere of the enclosed room (10).

9 Claims, 6 Drawing Sheets

SYSTEM AND METHOD FOR PREVENTING OR EXTINGUISHING FIRE

CROSS-REFERENCE TO RELATED APPLICATION

This application claims priority to European Patent Application No. 08171495.8, filed Dec. 12, 2008, entitled "INERTING METHOD FOR PREVENTING AND/OR EXTINGUISHING FIRE AS WELL AS INERTING SYSTEM TO REALIZE THE METHOD", which is incorporated herein by reference in its entirety.

BACKGROUND

The description relates generally to fire preventing or extinguishing systems for controlling the risk of fire.

SUMMARY

Provided herein is an inerting method for preventing and/or extinguishing fire in which a predefinable oxygen content, which is reduced compared to the normal ambient air, is set and maintained in the spatial atmosphere of an enclosed room.

To this end, an initial gas mixture comprising oxygen, nitrogen and other components as applicable is provided, wherein a gas separation system separates off at least a portion of the oxygen from this provided initial gas mixture and in so doing, a nitrogen-enriched gas mixture is provided at the outlet of the gas separation system, and wherein this nitrogenated gas mixture is introduced into the spatial atmosphere of the enclosed room.

Further provided herein is an inerting system for setting and/or maintaining a predefinable oxygen content which is reduced compared to the normal ambient in the spatial atmosphere of an enclosed room, wherein the inerting system comprises a gas separation system which separates off at least a portion of the oxygen contained in an initial nitrogen/oxygen gas mixture and in so doing, provides a nitrogen-enriched gas mixture at the outlet of the gas separation system, and wherein the inerting system comprises a supply line system for supplying the nitrogenated gas mixture to the enclosed room.

An inerting system of the above type is in particular a system to reduce the risk of and extinguish fires in a protected room subject to monitoring, wherein the protected room is continuously rendered inert for the purpose of preventing or controlling fire. The mechanism of action of such an inerting system counters the risk of fire in enclosed rooms by continuously lowering the concentration of oxygen in the respective area to a value of for example approximately 12-15% by volume. Several areas of application hereto include information technology areas, electrical switchgear and distributor compartments, enclosed facilities as well as storage areas for high-value commodities.

The resulting preventative or extinguishing effect of this inerting method is based on the principle of oxygen displacement. As is generally known, normal ambient air consists of about 21% oxygen by volume, about 78% nitrogen by volume and about 1% by volume of other gases. In order to be able to effectively reduce the risk of a fire breaking out in a protected room, the oxygen concentration in the respective room is reduced by introducing inert gas such as, for example, nitrogen. For most solids, a fire-extinguishing effect occurs when the percentage of oxygen falls below 15% by volume. Depending on the inflammable materials contained within the respective protected room, further lowering of the oxygen percentage to e.g. 12% by volume may additionally be necessary. Thus, continuously inerting the protected room will also effectively minimize the risk of a fire breaking out in said protected room.

Provided herein is an inerting system that can set and maintain a predefined inerting level in the enclosed room as economically as possible. In particular, a solution is to be specified with which the operating costs associated with inerting an enclosed room can be reduced. Additionally to be specified is a corresponding inerting method which allows the economical and in particular continuous inertization of an enclosed room.

With respect to the method, this task is solved by an inerting method of the type cited above in that the gas separation system is controlled such that the residual oxygen content of the nitrogenated gas mixture is adjusted to a value selected as a function of the oxygen content prevailing at that moment in the spatial atmosphere of the enclosed room.

With respect to the mechanism, an inerting system of the type includes a control device designed to control the gas separation system such that the residual oxygen content of the nitrogenated gas mixture is adjusted to a value selected as a function of the oxygen content prevailing at that moment in the spatial atmosphere of the enclosed room.

The nitrogen purity of the nitrogenated gas mixture provided at the outlet of the gas separation system, and respectively the residual oxygen content of the nitrogenated gas mixture provided at the outlet of the gas separation system, has an effect on the so-called "drop time." The term "drop time" refers to the length of time required to adjust the spatial atmosphere of the enclosed room to the predefined inerting level.

Specifically, as it is herein described, as nitrogen purity increases, the air factor of the gas separation system rises exponentially.

The term "air factor" refers to the ratio of the volume of initial gas mixture provided the gas separation system per unit of time to the volume of nitrogenated gas provided at the outlet of the gas separation system per unit of time. Nitrogen generators usually allow the arbitrary selection of nitrogen purity at the outlet of the gas separation system and same can be set on the nitrogen generator itself. Generally valid hereto is that the lower the nitrogen purity is set, the lower the operating costs for the nitrogen generator. This then enables the compressor to run for a comparatively shorter period when providing a nitrogenated gas mixture at the set nitrogen purity at the outlet of the gas separation system.

As regards the operating costs for the inerting system when inerting the room, however, other additional factors need to be taken into account. Such factors particularly include the purge factors which, by means of the nitrogenated gas mixture provided at the outlet of the gas separation system, displaces the oxygen in the spatial atmosphere of the enclosed room until the predefined inerting level can be reached, respectively maintained. These purge factors particularly include the volume of nitrogenated gas provided by the gas separation system per unit of time, the spatial volume of the enclosed room, and the difference between the oxygen content prevailing at that moment in the spatial atmosphere of the enclosed room and the oxygen content which corresponds to the predefined inerting level. To be hereby considered is that in terms of the drop time, the nitrogen purity of the gas mixture provided at the outlet of the gas separation system, respectively the residual oxygen content of the nitrogenated gas mixture, likewise plays a crucial role, since the purging operation goes faster the lower the residual oxygen content in the nitrogenated gas mixture.

The term "gas separation system" as used herein is to be understood as a system which can effect the separation of an initial gas mixture, comprising at least the components of "oxygen" and "nitrogen," into an oxygen-enriched gas as well as a nitrogen-enriched gas. The functioning of such a gas separation system is usually based on the effect of gas separation membranes. The gas separation system may be designed to separate oxygen from the initial gas mixture. This type of gas separation system is frequently also referred to as a "nitrogen generator."

This type of gas separation system makes use of, for example, a membrane module or the like, in which the different components contained in the initial gas mixture (e.g. oxygen, nitrogen, noble gases, etc.) diffuse through the membrane at different speeds based on their molecular structure. A hollow fiber membrane can be used as the membrane. Oxygen, carbon dioxide and hydrogen have a high diffusion rate and because of that, escape from the initial gas mixture relatively quickly when passing through the membrane module. Nitrogen with a low diffusion rate percolates through the hollow fiber membrane of the membrane module very slowly and thereby concentrates in same when passing through said hollow fiber/membrane module. The nitrogen purity, or the residual oxygen content respectively, of the gas mixture exiting the gas separation system is determined by the flow-through rate. Varying the pressure and the flow rate allows the gas separation system to be adjusted to the required nitrogen purity and necessary amount of nitrogen. Specifically, the purity of the nitrogen is regulated by the speed at which the gas passes through the membrane (dwell time).

The separated oxygenated gas mixture is usually concentrated and discharged into the environment at atmospheric pressure. The compressed, nitrogenated gas mixture is provided at the outlet of the gas separation system. An analysis of the product gas composition ensues by measuring the residual oxygen content in volume percent. The nitrogen content is calculated by subtracting the measured residual oxygen content from 100%. In so doing, it needs to be considered that although this value is designated as the nitrogen content or the nitrogen purity, it is—in reality—the inert content, since this component flow does not consist solely of nitrogen, but also other gas components such as, for example, noble gases.

The gas separation system, nitrogen generator respectively, is usually fed compressed air which has been purified by upstream filter units. It is in principle conceivable to use a pressure swing process (PSA technology) utilizing two molecular sieve beds to provide the nitrogenated gas, whereby the two sieves are alternatingly switched from a filter mode to a regeneration mode, thereby yielding the flow of nitrogenated gas.

When, for example, a membrane technology is employed in a nitrogen generator, use is made of the general knowledge that different gases diffuse through materials at different rates of speed. In the case of nitrogen generator technology, the different diffusion rates of the principal components of air; i.e. nitrogen, oxygen and water vapor, are used to generate a flow of nitrogen, respectively nitrogenated air. In detail, to technically realize a membrane technology-based nitrogen generator, a separation material which offers excellent diffusion to water vapor and oxygen, however only a low diffusion rate for nitrogen, is applied to the outer surfaces of hollow fiber membranes. When air passes through the inside of such a treated hollow fiber, the water vapor and oxygen quickly diffuse outward through the hollow fiber wall, while the nitrogen is largely held within the fiber such that a strong concentration of nitrogen builds up during passage through the hollow fiber. The effectiveness of this separation process fundamentally depends on the flow rate in the fiber and the distanced pressure difference versus the hollow fiber wall. With decreasing flow rate and/or a higher pressure difference between the interior and the exterior of the hollow fiber membrane, the purity of the resultant nitrogen flow rises. Generally speaking, a membrane technology-based nitrogen generator can thus regulate the degree of nitrogenization in the nitrogenated air provided by the nitrogen generator as a function of the dwell time of the compressed air provided by the compressed air source in the air separation system of the nitrogen generator.

If, on the other hand, PSA technology is employed in the nitrogen generator, for example, specially-treated activated charcoal makes use of the different binding rates of the atmospheric oxygen and atmospheric nitrogen. The structure of the activated charcoal employed is thereby changed so as to render an extremely large surface area with a large number of micropores and submicropores (d<1 nm). At such a pore size, the oxygen molecules of the air diffuse into the pores substantially faster than the nitrogen molecules so that the air in the proximity of the activated charcoal becomes enriched with nitrogen. In the case of a PSA technology-based nitrogen generator, the degree of nitrogenization in the nitrogenated air provided by the nitrogen generator can thus be regulated—as is also the case with a membrane technology-based generator—as a function of the dwell time of the compressed air provided by the compressed air source in the nitrogen generator.

On the one hand, the air factor of the gas separation system increases exponentially with increasing nitrogen purity and, on the other hand, in order to set a predefined inerting level, the compressor of the inerting system has to run for a longer period of time the lower the difference is between the oxygen content prevailing at that moment in the spatial atmosphere of the enclosed room and the residual oxygen content in the nitrogenated gas mixture. It is hereby to be taken into account that the power consumption of the inerting system is virtually directly proportional to the length of time the drop process takes for a room to be rendered inert, whether to set the room at a fixed residual oxygen content or when lowering to a new drop level, since the compressor upstream of the gas separation system is digitally driven to its operating point at optimum efficiency.

Therefore it remains to be noted that—when a lower value of e.g. only 90% by volume is selected for the nitrogen purity—the inert gas system has to run for a relatively long period of time in order to set an inerting level. Should the nitrogen purity value be raised for example to 95% by volume, the difference between the oxygen content of the inerting level to be set and the residual oxygen content of the gas mixture provided at the outlet of the gas separation system likewise increases, which thereby lowers the compressor's necessary runtime, and thus lowers the power consumption of the inerting system, involved in setting an inerting level. However the circumstance of increasing the nitrogen purity at the outlet of the gas separation system inevitably also increasing the air factor likewise has an effect here. As regards the runtime of the compressor, or the power consumption of the inerting system, required to set an inerting level, this circumstance has a negative effect. This negative effect prevails if the increase in the air factor due to increasing the nitrogen purity becomes appreciable.

Embodiments described herein recognize that when rendering a enclosed room inert, the residual oxygen content provided at the outlet of the gas separation system and the nitrogenated gas mixture is to be automatically adjusted to the oxygen content prevailing at that moment in the spatial atmosphere of the enclosed room in order to thus set the nitrogen purity of the gas separation system to a value which is optimized in terms of the time required.

The phrase "time-optimized nitrogen purity value" as used herein is to be understood as the nitrogen purity of the gas separation system or the residual oxygen content provided at the outlet of the gas separation system and the nitrogenated gas mixture, with which a defined inerting system, with which the volume of nitrogenated gas mixture available per unit of time is constant, assumes a minimum time period for lowering from a current oxygen content to a predefined oxygen content corresponding to a given inerting level.

An embodiment of the inerting method herein provides for the residual oxygen content of the nitrogenated gas mixture, the nitrogen purity of the gas separation system respectively, to be automatically set according to a predetermined characteristic curve. This characteristic curve indicates the time-optimized behavior of the residual oxygen content in the nitrogenated gas mixture in relation to the oxygen content in the spatial atmosphere of the enclosed room. The phrase "time-optimized behavior of the residual oxygen content" refers to the time-optimized value of the residual oxygen content dependent on the oxygen content in the spatial atmosphere of the enclosed room. As indicated above, the time-optimized value of the residual oxygen content corresponds to the value of the residual oxygen content to be selected for the gas separation system such that the inerting method can set a predefinable oxygen content which is reduced compared to the normal ambient air in the spatial atmosphere of the enclosed room within the shortest period of time.

The characteristic curve, according to which the residual oxygen content is set as a factor of the oxygen content prevailing at that moment in the spatial atmosphere of the enclosed room with the inerting method herein, is predetermined (measured or calculated) for the gas separation system/inerting system.

Since the description herein describes the automatic adjusting of the nitrogen purity of the gas separation system, and the residual oxygen content in the nitrogenated gas mixture respectively, as a function of the oxygen content prevailing at that moment in the spatial atmosphere of the enclosed room so as to thereby be able to render the room inert at the lowest possible operating costs, the system and method described can measure the current oxygen content in the spatial atmosphere of the enclosed room either directly or indirectly continuously or at predefined times and/or upon predefined events. In a further embodiment, for the residual oxygen content in the nitrogenated gas mixture to be set to a predefined, time-optimized value continuously or at predefined times and/or upon predefined events. This predefined, time-optimized value is to correspond to a residual oxygen content at which the inerting method can lower the oxygen content in the spatial atmosphere of the enclosed room to a predefined drawdown based on the respectively current oxygen content within the shortest time possible.

In another embodiment, not only is the nitrogen purity of the gas separation system changed as a function of the oxygen content prevailing at that moment in the spatial atmosphere of the enclosed room, but also the oxygen content in the initial gas mixture is changed as a function of the oxygen content prevailing at that moment in the enclosed room's spatial atmosphere. The air factor of the gas separation system can be lowered when the initial gas mixture supplied to the gas separation system exhibits a reduced oxygen content.

Thus, with respect to providing the initial gas mixture, the description herein provides for the regulated withdrawing of a portion of the ambient air from within the enclosed room and the regulated supplying of fresh air to the withdrawn portion of the room's air. So as to prevent the pressure inside the enclosed room from changing by the supplying of nitrogenated gas or by the drawing off a portion of its ambient air, the amount of fresh air admixed to the ambient air drawn from the room is selected such that the amount of ambient air withdrawn from the room per unit of time is identical to the volume of nitrogenated gas mixture provided at the outlet of the gas separation system and piped to the spatial atmosphere of the enclosed room per unit of time.

DETAILED DESCRIPTION

Figure 1:
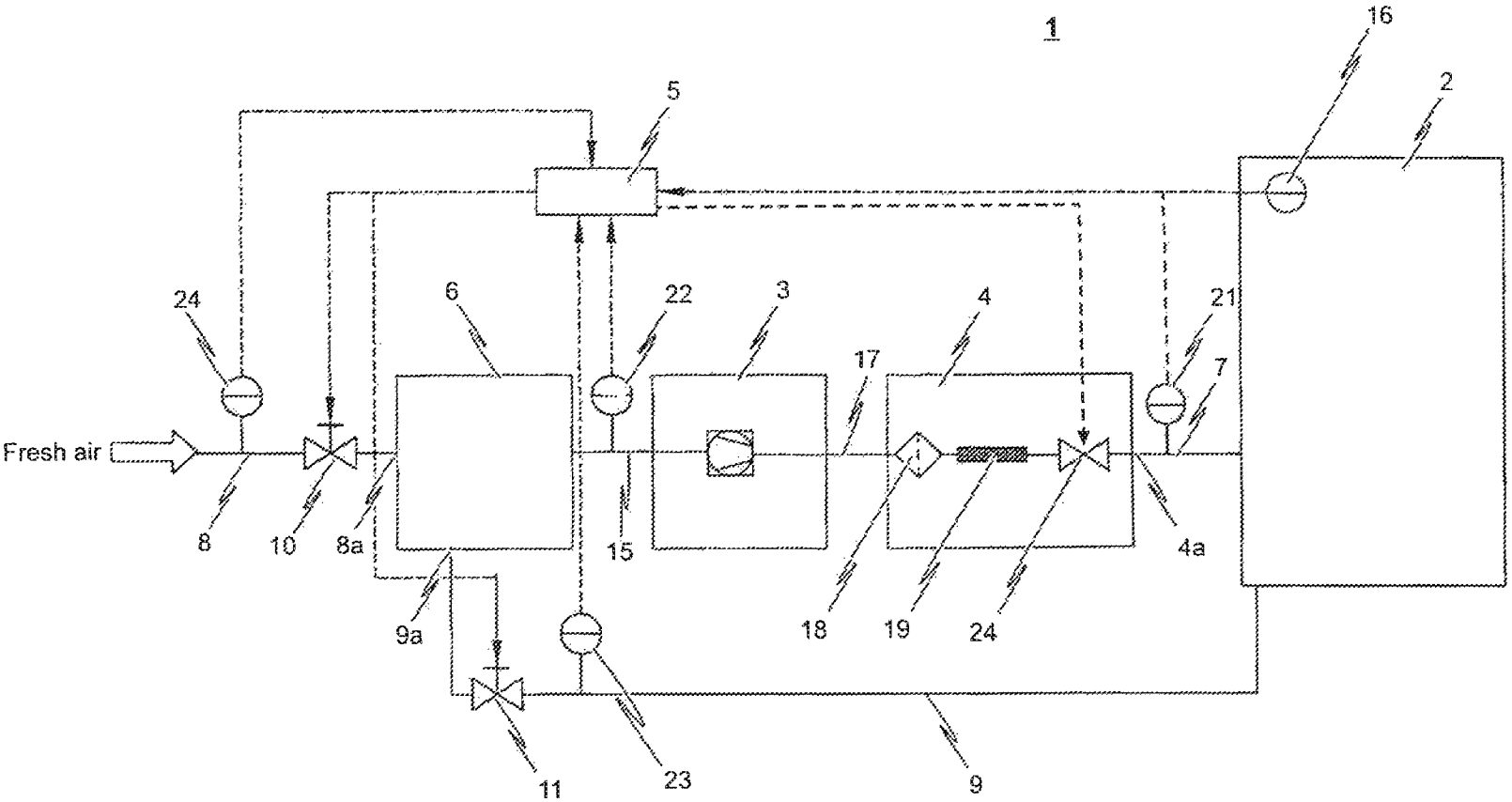
FIG. 1 is a schematic view of an inerting system in accordance with a first embodiment.

FIG. 1 shows an example of a first embodiment of an inerting system 1 in a schematic representation. The inerting system 1 depicted serves to set and maintain a predefinable inerting level in the spatial atmosphere of an enclosed room 2. The enclosed room 2 can be e.g. a stockroom in which the oxygen content in the ambient air is lowered to and maintained at a specific inerting level of, for example, 12% or 13% by volume of oxygen as a preventive protection measure against fire.

The enclosed room 2 is selectively automatically rendered inert with the aid of a control device 5. To this end, the inerting system 1 according to the embodiment depicted in FIG. 1 comprises a gas separation system consisting of a compressor 3 as well as a nitrogen generator 4. The compressor 3 serves to provide a compressed initial gas mixture to the nitrogen generator 4 which comprises at least the components of oxygen and nitrogen. To this end, the outlet of the compressor 3 is connected to the inlet of the nitrogen generator 4 by means of a line system 17 in order to supply the nitrogen generator 4 with the compressed initial gas mixture. It is conceivable to compress the initial gas mixture at the outlet of the compressor 3 to a pressure of e.g. 7.5 to 9.5 bar and in one embodiment 8.8 bar.

The nitrogen generator 4 comprises at least one membrane module 19, for example a hollow fiber membrane module, through which the initial gas mixture provided by the compressor 3—after passing through an applicable filter 18—is pressed. Within the membrane module 19, the different components contained in the initial gas mixture (in particular oxygen and nitrogen) diffuse through the hollow fiber membrane of the membrane module 19 at different rates according to their molecular structure. The gas separation is thereby based on the operating principle according to which nitrogen very slowly penetrates the hollow fiber membrane at a low diffusion rate and, in so doing, enriches the hollow fiber membrane of the membrane module 19 as it passes through. A nitrogenated gas mixture is thereby provided at the outlet 4*a* of nitrogen generator 4. This nitrogenated gas mixture is—as is also the initial gas mixture supplied at the inlet of the nitrogen generator 4—in compressed form, wherein passing through the at least one membrane module 19 of the nitrogen generator 4 does, however, lead to a drop in pressure of e.g. 1.5 to 2.5 bar.

Although not explicitly depicted in FIG. 1, the oxygenated gas mixture separated out in the nitrogen generator 4 is concentrated and discharged to the surroundings at atmospheric pressure.

The nitrogenated gas mixture provided at the outlet 4*a* of nitrogen generator 4 is fed to the enclosed room 2 through a supply line 7 in order to lower the oxygen content in the spatial atmosphere of the enclosed room 2, respectively to maintain a previously-set drop level in room 2 by adjusting the nitrogenated gas.

So that the pressure inside the enclosed room 2 does not change with the supplying of the nitrogenated gas mixture, an applicable pressure relief is to be provided. This can be realized for example as independently opening and/or closing pressure relief valves (not shown in FIG. 1). On the other hand, it is also conceivable that for the purpose of pressure relief when rendering room 2 inert, the discharged volume of ambient air can be supplied to a mixing chamber 6 via a return line system 9.

The ambient air discharged from the enclosed room 2 is supplied to the mixing chamber 6 via a first inlet 9*a* of the return line 9. The mixing chamber 6 further comprises a second inlet 8*a* which opens to a supply line system 8 for supplying fresh air to the mixing chamber 6. The initial gas mixture, compressed by compressor 3 and from which at least a portion of the oxygen is separated off in the gas separation system (nitrogen generator 4), is prepared in the mixing chamber 6. For this reason, the outlet of the mixing chamber 6 is connected to the inlet of the compressor 3 by an appropriate line system 15.

In detail, a first valve 11 controllable by means of a control device 5 is provided in the return line system 9, realized in particular as a shut-off valve, and a second valve 10 likewise controllable by means of control device 5 is provided in the fresh air supply line system 8, in particular in the form of a shut-off valve. Doing so thus ensures that with the appropriate actuation of the respective valves 10, 11, the amount of fresh air mixed with the ambient air withdrawn from room 2 will be selected such that the volume of air withdrawn from room 2 per unit of time is identical to the volume of nitrogenated gas mixture provided at the outlet 4*a* of nitrogen generator 4 as piped in to the spatial atmosphere of the enclosed room 2 per unit of time.

The inerting system 1 according to the embodiment depicted schematically in FIG. 1 is characterized by the above-cited control device 5 being connected to the correspondingly controllable components of the inerting system 1 and designed so as to automatically control the nitrogen generator 4, the gas separation system 3, 4 respectively, such that the nitrogenated gas mixture provided at the outlet 4*a* of the gas separation system 3, 4 exhibits a residual oxygen content which is dependent on the oxygen content prevailing at that moment in the spatial atmosphere of the enclosed room 2. In particular, the depicted inerting system 1 is controlled by means of the control device 5 of nitrogen generator 4 such that depending on the oxygen content in the spatial atmosphere of the enclosed room 2 measured by means of an oxygen measuring system 16, the nitrogenated gas mixture will exhibit a residual oxygen content of between 10.00% to 0.01% by volume, wherein the residual oxygen content of the nitrogenated gas mixture decreases with decreasing oxygen content in the spatial atmosphere of the enclosed room.

To this end, the inerting system 1, in addition to the above-mentioned oxygen measuring system 16 for measuring or detecting the current oxygen content in the spatial atmosphere of the enclosed room 2, further comprises a residual oxygen content measuring system 21 for measuring the residual oxygen content in the nitrogenated gas mixture provided at the outlet 4*a* of the nitrogen generator 4, respectively for determining the nitrogen purity of the gas mixture provided at the outlet 4*a* of the nitrogen generator 4. Both measuring systems 16, 21 are correspondingly connected to the control device 5.

Figure 2:
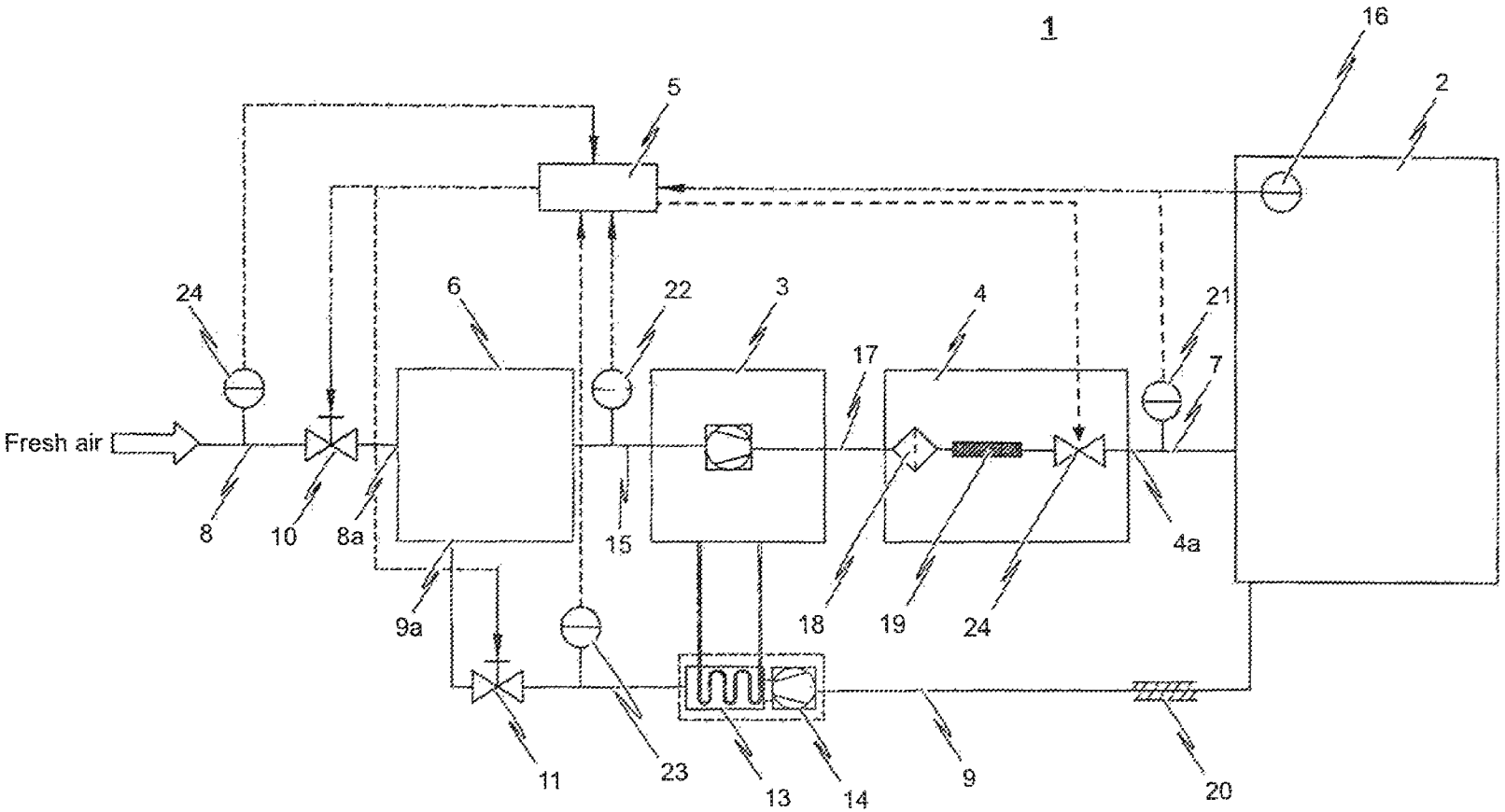
FIG. 2 is a schematic view of an inerting system in accordance with a second embodiment.

FIG. 2 shows a schematic view of an inerting system 1 according to a second embodiment. The inerting system 1 according to the second embodiment is in particular suited to setting and maintaining a predefined inerting level in an air-conditioned room such as, for example, a cold storage room or a refrigerated warehouse, as economically as possible. The structure and the functioning of the inerting system 1 according to the embodiment depicted in FIG. 2 corresponds essentially to the structure and functioning of the inerting system described above with reference to FIG. 1 so that to avoid repetition, the following will only address the differences.

As depicted in FIG. 2, for the most economic inertization of an air-conditioned room 2, one embodiment provides a heat exchanger system 13 in the return line system 9 between the room 2 and the mixing chamber 6. In a further embodiment, —as shown in FIG. 2—the return line system 9 may be at least partly sheathed in an appropriate thermal insulation 20 so as to prevent freezing of the return line system 9 when the chilled ambient air withdrawn from the enclosed room 2 is fed to the heat exchanger system 13 via the return line system 9 before the ambient air is then piped in to the mixing chamber 6. The heat exchanger system 13 can comprise a supporting fan 14 as needed so that the ambient air can be withdrawn from the spatial atmosphere of the enclosed room 2 without a drop in pressure.

The heat exchanger system 13 thereby serves to utilize at least a portion of the waste heat resulting from operating the compressor 3 in order to accordingly warm the room's withdrawn and cooled ambient air. Different systems are used for the heat exchanger system 13, such as e.g. a fin coil heat exchanger, which transfers at least a portion of the thermal energy of the exhaust air from compressor 3 to the air withdrawn from the room by means of a heat exchange medium such as, for example water, so as to raise the temperature of the withdrawn ambient air to a moderate temperature of for example 20° C., which may be advantageous in terms of the functioning and the efficiency of the nitrogen generator 4.

After the ambient air withdrawn from the enclosed room 2 has filtered through the heat exchanger system 13, it is fed to the mixing chamber 6 via a first inlet 9*a* of the return line system 9. The mixing chamber 6 further comprises a second inlet 8*a* into which a supply line system 8 feeds for supplying fresh air to the mixing chamber 6. The initial gas mixture, compressed by compressor 3 and from which at least a portion of the oxygen is separated off in the gas separation system (nitrogen generator 4), is provided in the mixing chamber 6. For this reason, the outlet of the mixing chamber 6 is connected to the inlet of the compressor 3 by means of an appropriate line system 15.

Figure 3:
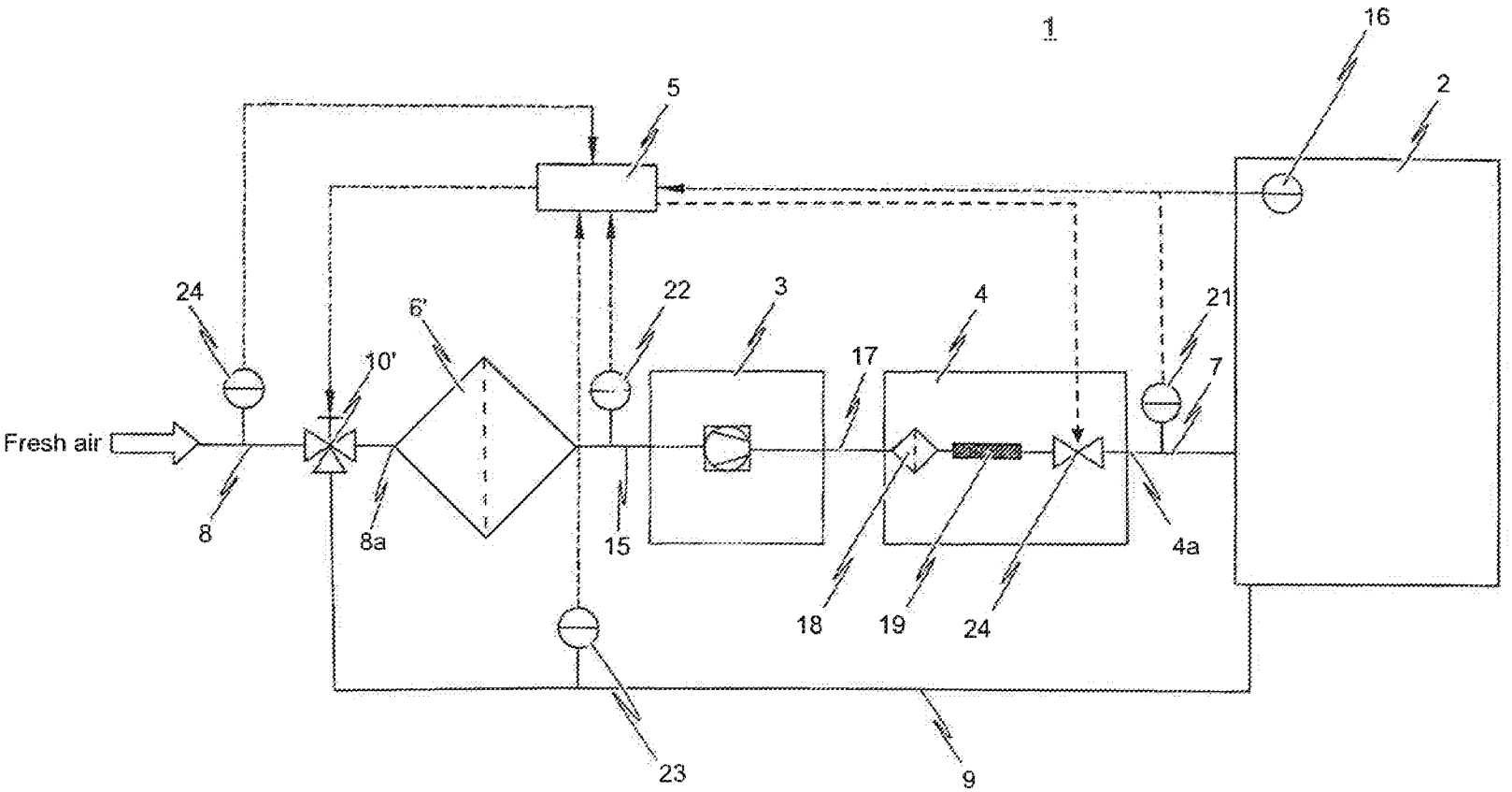
FIG. 3 is a schematic view of an inerting system in accordance with a third embodiment.

FIG. 3 shows a schematic view of an inerting system 1 according to a third embodiment. The structure and the functioning of the inerting system 1 according to the embodiment depicted in FIG. 3 essentially corresponds to the structure and functioning of the inerting system described above with reference to FIG. 1 so that to avoid repetition, the following will only address the differences.

As depicted in FIG. 3, in this embodiment, the two valves 10, 11, which in the embodiment according to FIG. 1 are in particular configured as shut-off valves and provided in the fresh air supply line system 8, the return line system 9 respectively, have been combined into one 3-way valve 10' so as to simplify the structure of inerting system 1. The 3-way valve 10' is controllable by means of control device 5.

The mixing chamber depicted in the FIG. 3 embodiment is furthermore realized as a filter 6'. The mixing chamber realized as a filter 6' thus fulfills two functions: it first serves to provide the initial gas mixture, and that by mixing the fresh air supplied via the fresh air supply line system with the ambient air withdrawn from room 2 supplied by the return line system 9. The mixing chamber realized as filter 6' secondly serves to filter the provided initial gas mixture prior to it being compressed by compressor 3. This thus dispenses with the need for an additional filter at the inlet of compressor 3.

As set forth in detail in the following with reference being made to the graphs in accordance with FIGS. 4 to 6, the appropriate adjusting of the nitrogen purity of nitrogen generator 4, respectively the appropriate adjusting of the residual oxygen content of the nitrogenated gas mixture provided at the outlet 4*a* of gas separation system 4, enables a predefined drop level to be set in the spatial atmosphere of the enclosed room in a manner which is optimized in terms of the time required. Accordingly, the solution thereby provides for the nitrogen purity of the nitrogen generator 4 to be set and adjusted as a function of the oxygen content prevailing at that moment in the spatial atmosphere of the enclosed room when rendering said enclosed room 2 inert.

The nitrogen purity can be changed by varying the dwell time of the initial gas mixture in the at least one membrane module 19 of the nitrogen generator 4. It is hereby conceivable, for example, to regulate the flow and back-pressure through the membrane module 19 by means of a suitable control valve 24 at the outlet of membrane module 19. A high pressure on the membrane and a long dwell time (lower flow) result in a high nitrogen purity at outlet 4*a* of the nitrogen generator.

A time-optimized value may be selected for the respective nitrogen purity which enables the inerting system to set and maintain a predefined inerting level in the enclosed room 2 within the shortest possible time. By making use of appropriate time-optimized values for the nitrogen purity when setting and maintaining a predefined inerting level in the spatial atmosphere of the enclosed room, it is possible to reduce the time required for the drop process (whether for controlling a continued fixed residual oxygen content or when lowering to a new drop level) and thus also reduce the energy required by the inerting system since the compressor 3 is digitally driven (in/out) to its operating point at optimized efficiency.

The inerting system 1 according to the embodiment depicted in FIG. 1 or 2 is further characterized by the mixing chamber 6 providing the gas separation system consisting of the compressor 3 and the nitrogen generator 4 with an initial gas mixture which can exhibit a lower oxygen content than the oxygen content of normal ambient air (i.e. approx. 21% by volume). Specifically, the above-cited return line system 9 is provided for this purpose, with which at least a portion of the ambient air of the enclosed room 2 can be supplied to the mixing chamber 6 through valve 11 in a manner regulated by control device 5. Thus, when the oxygen content has already been reduced in the enclosed room 2, the return line system 9 will supply the mixing chamber 6 with a gas mixture which is nitrogen-enriched compared to the normal ambient air. This portion of the room's air is mixed with supply air in mixing chamber 6 in order to provide the compressor 3, the nitrogen generator 4 respectively, with the required volume of initial gas mixture. Since the oxygen content of the initial gas mixture exerts an influence on the air factor of the gas separation system, the nitrogen generator 4 respectively, and thus also an influence on the time-optimized value for the nitrogen purity of nitrogen generator 4, the embodiment of the inerting system 1 depicted in FIG. 1 provides for an oxygen measuring system 22 in the line system 15 between the outlet of the mixing chamber 6 and the inlet of the compressor 3 to measure the oxygen content in the output gas mixture. It is furthermore optionally conceivable here to provide corresponding oxygen measuring systems 23, 24 in the return line system 9, the fresh air supply line 8 respectively, in order to measure the oxygen content in the supply air and in the nitrogenated room air continuously or at predefined times or upon predefined events. On the basis of the measured readings, the composition of the initial gas mixture (in particular in terms of oxygen content) can be appropriately controlled by the corresponding actuation of valves 10 and/or 11.

The mode of operation of the inerting system 1 depicted schematically in FIG. 1 or 2 will be described in the following with reference being made to the graphs pursuant FIGS. 4 to 6. For the present description of the inerting system 1 depicted schematically in FIG. 1 or 2, the assumption is to be made that the enclosed room 2 has a spatial volume of 1000 cubic meters. It is to be further assumed that the inerting system 1 is designed so as to provide a maximum total of 48 cubic meters nitrogenated gas per hour at the outlet 4*a* of nitrogen generator 4.

Figure 4:
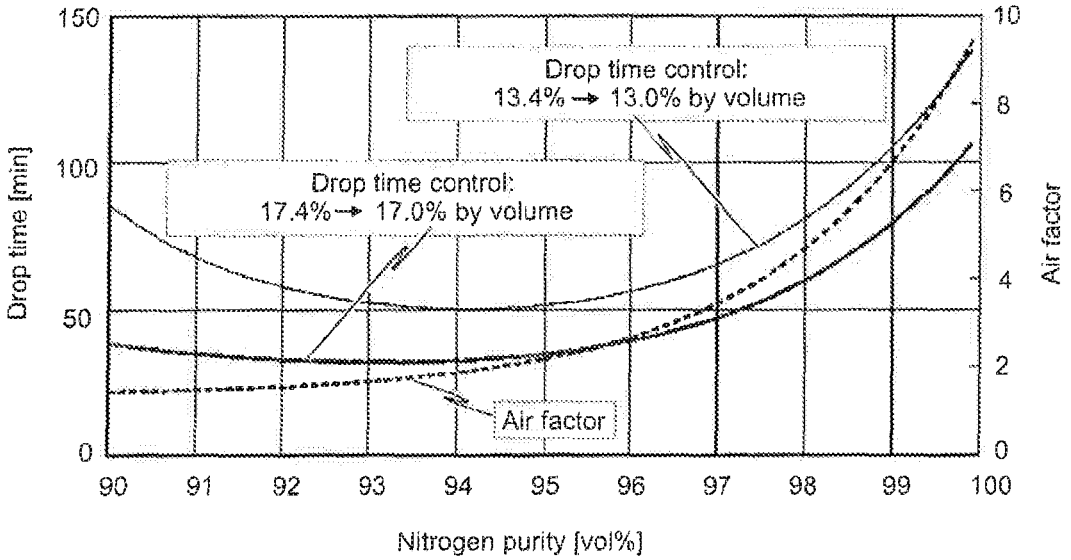
FIG. 4 is a graph of the air factor in relation to the nitrogen purity with the inerting system, as well as a graph of the drop time in relation to the nitrogen purity, specifically the lowering of the oxygen content from its original 17.4% by volume to 17.0% by volume as well as a lowering of the oxygen content from its original 13.4% by volume to 13.0% by volume.

FIG. 4 represents a graph of the air factor for the nitrogen generator 4 employed in the inerting system 1 depicted schematically in FIG. 1 or FIG. 2 at different nitrogen purities. In conjunction hereto, it is to be noted that the air factor increases exponentially as the residual oxygen content of the nitrogenated gas mixture provided at the outlet 4*a* of nitrogen generator 4 decreases. Specifically, the air factor at a residual oxygen content of 10% by volume (nitrogen purity: 90%) is approximately 1.5, which means that a volume of 0.67 cubic meters of nitrogenated gas mixture can be provided at outlet 4*a* of nitrogen generator 4 per cubic meter initial gas mixture. This relationship declines with increasing nitrogen purity, as can be seen from the FIG. 4 graph.

FIG. 4 additionally depicts the progression of the air factor, how the regulating drop time reacts with increasing nitrogen purity at different nitrogen purities. Specifically, it is firstly depicted how long the compressor 3 needs to run in order to lower the oxygen content in the spatial atmosphere of the enclosed room 2 from its original 17.4% by volume to 17.0% by volume. Secondly depicted is then how long the compressor 3 needs to run in order to lower the oxygen content in the spatial atmosphere of the enclosed room 2 from its original 13.4% by volume to 13.0% by volume with the inerting system 1 according to FIG. 1 or 2.

The comparison of the two drop times (drop time control of 17.4%→17.0% by volume and drop time control of 13.4%→13.0% by volume) shows that to set and maintain an inerting level of 17.0% by volume, the runtime of the compressor 3 can be minimized when a nitrogen purity of approx. 93.3% by volume is set at nitrogen generator 4. To set and maintain an inerting level of 13% by volume oxygen content, however, the time-optimized purity is then at about 94.1% by volume nitrogen. Hence the drop time, the runtime of compressor 3 respectively, for setting a predefined inerting level for the spatial atmosphere of enclosed room 2 is dependent upon the nitrogen purity as set with nitrogen generator 4, respectively upon the residual oxygen content set with nitrogen generator 4 for the nitrogenated gas mixture provided at the outlet 4*a* of the nitrogen generator 4.

The respective minima of the drop time relative the nitrogen purity is referred to in the following as "time-optimized nitrogen purity." The FIG. 5 graph depicts the time-optimized nitrogen purity for the inerting system 1 according to FIG. 1 or 2. Specifically, the time-optimized purity which applies to the gas separation system 3, 4 of the inerting system 1 pursuant FIG. 1 or 2 is indicated for the different oxygen concentrations in the spatial atmosphere of enclosed room 2.

Figure 5:
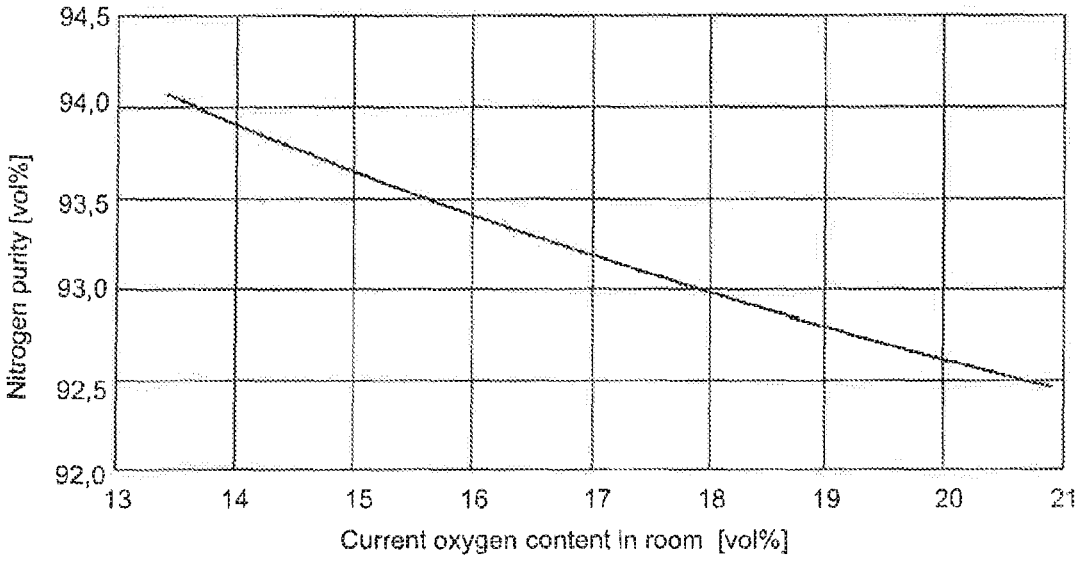
FIG. 5 is a graph of the time-optimized nitrogen purity in relation to the current oxygen content in the spatial atmosphere of the enclosed room with the inerting system.

It can be directly inferred from the characteristic curve depicted in FIG. 5 that the nitrogen generator 4 is to be adjusted such that with decreasing oxygen content in the spatial atmosphere of enclosed room 2, the residual oxygen content in the gas mixture provided at the outlet 4*a* of gas separation system 3, 4 decreases. When the nitrogen generator is accordingly operated pursuant the nitrogen purity characteristic curve depicted in FIG. 5 when rendering the enclosed room 2 inert, it is possible to set and maintain the predefined inerting level in the spatial atmosphere of enclosed room 2 with the shortest possible runtime of compressor 3 and thus the lowest possible expenditure of energy.

Figure 6:
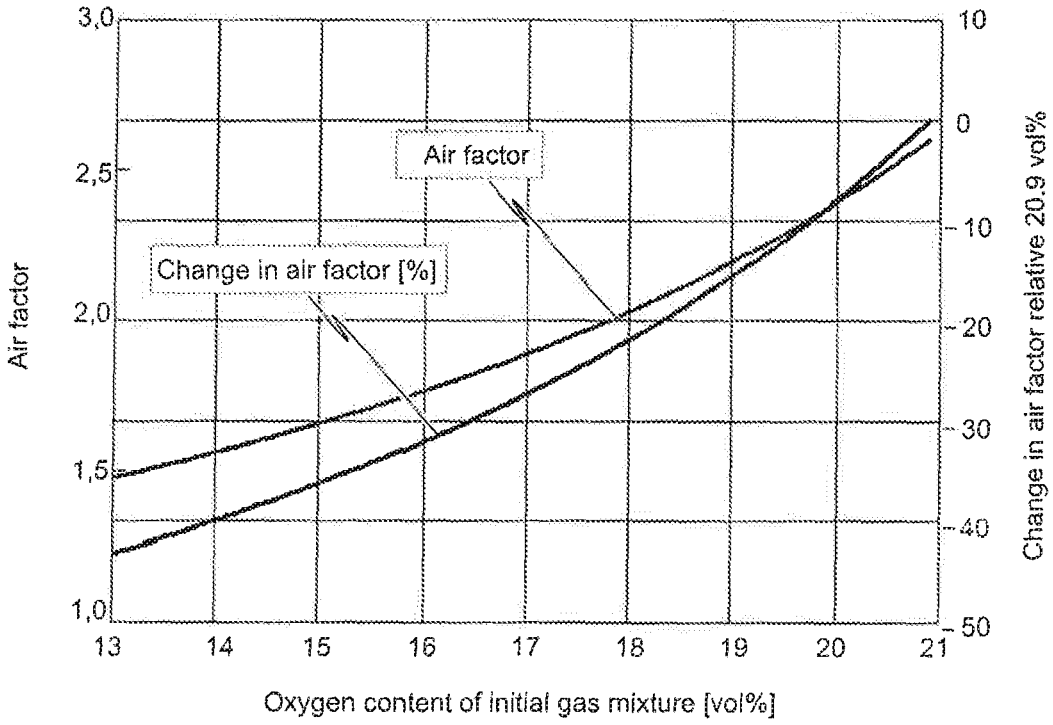
FIG. 6 is a graph of the air factor of the gas separation system with the inerting system in relation to the oxygen content of the initial gas mixture supplied to the gas separation system in order to separate at least a portion of the oxygen from the initial gas mixture and thereby provide a nitrogenated gas mixture at the outlet of the gas separation system.

FIG. 6 is a graph of the influence the oxygen content in the initial gas mixture has on the air factor of gas separation system 3, 4. According thereto, at a fixed nitrogen purity of the gas separation system 3, 4, the air factor drops as the oxygen content is reduced in the initial gas mixture. As indicated above, the return supply line 9 is provided for the inerting system 1 in accordance with the schematic diagram of FIG. 1 by means of which a portion of the ambient air from the room (already nitrogenated as applicable) is fed to the mixing chamber 6 in regulated manner so as to thus reduce the oxygen content in the initial gas mixture from its original 21% by volume (oxygen content of normal ambient air). This recirculation of the room's already nitrogenated air can thus further reduce the air factor of the gas separation system 3, 4 so that the efficiency of the gas separation system 3, 4 will be increased and the energy required to set and maintain a predefined inerting level can be even further reduced.

The characteristic curve depicted in FIG. 6 may be combined in such a manner with the method which FIGS. 4 and 5 graphically depict that an optimized supply of nitrogen is enabled at each oxygen concentration of the initial gas mixture and in room 2.

Figure 7:
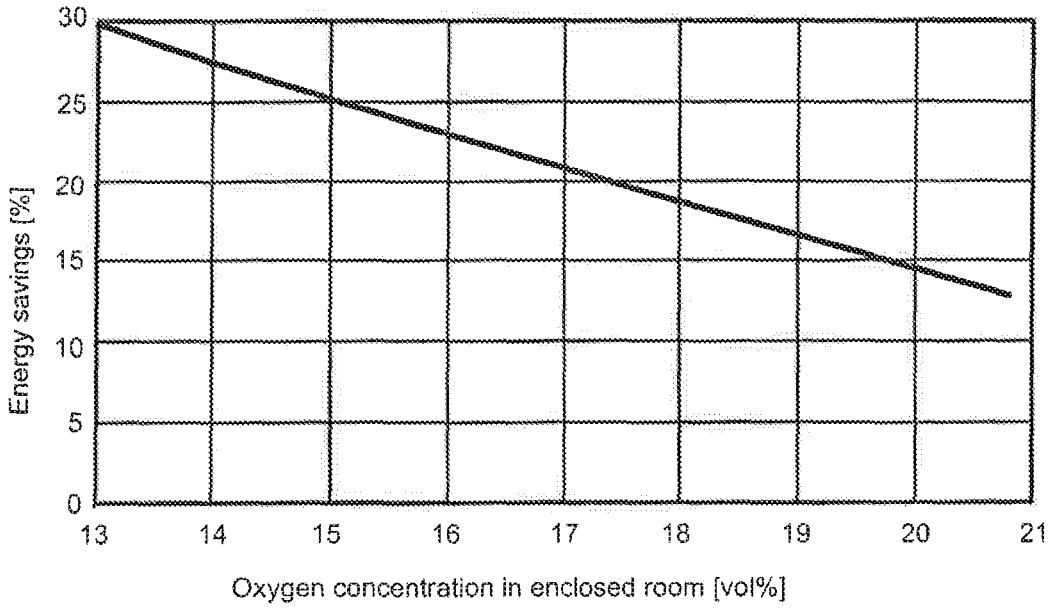
FIG. 7 is a graph of the energy savings which can be achieved by lowering the oxygen content of the enclosed room's spatial atmosphere.

FIG. 7 depicts—for a calculated application—the energy savings attainable (in %) with the oxygen content set in the spatial atmosphere of an enclosed room when the oxygen concentration in the spatial atmosphere of the enclosed room is lowered by means described further herein. The case considered here is one in which the time-optimized nitrogen purity was selected for the nitrogen purity of the nitrogen generator during the inerting of the room on the one hand and, on the other, the room air already nitrogenated was recirculated so as to thereby further reduce the air factor of the nitrogen generator and increase its efficiency.

What is claimed is:

1. A method comprising:

(a) providing an initial gas mixture comprising oxygen and nitrogen by supplying a portion of ambient air of an enclosed room to a mixing chamber and by mixing the portion of ambient air of the enclosed room with fresh air in the mixing chamber;

(b) flowing the initial gas mixture provided in step (a) to a gas separation system comprising a nitrogen generator;

(c) separating at least a portion of the oxygen from the initial gas mixture via the nitrogen generator, thereby producing a nitrogen-enriched gas mixture having a residual oxygen content; and (d) flowing the nitrogen-enriched gas mixture of the gas separation system having the residual oxygen content into the enclosed room, wherein the method further comprises the following steps:

(i) measuring an oxygen level of a spatial atmosphere of the enclosed room;

(ii) measuring the residual oxygen content of the nitrogen-enriched gas mixture at an outlet of the nitrogen generator;

(iii) controlling the operation of the nitrogen generator so as to achieve a gas mixture having a residual oxygen content, wherein the operation of the nitrogen generator is controlled based on the measured oxygen level of the spatial atmosphere of the enclosed room and also based on the measured residual oxygen content of the nitrogen-enriched gas mixture at the outlet of the nitrogen generator.

2. The method according to claim 1, comprising:

removing, in response to the flowing step (d), ambient air from the enclosed room; and mixing, outside the enclosed room, the ambient air with fresh air.

3. The method according to claim 2, wherein the volume of the ambient air of the removing step is equivalent to the volume of the nitrogen-enriched gas mixture of the flowing step (d).

4. The method of claim 1, wherein the controlling of the operation of the nitrogen generator comprises varying dwell time of the nitrogen generator so as to achieve the residual oxygen content.

5. The method of claim 1, wherein the controlling of the operation of the nitrogen generator comprises varying pressure of the nitrogen generator so as to achieve the residual oxygen content.

6. A method comprising:

(a) providing an initial gas mixture comprising oxygen and nitrogen by supplying a portion of ambient air of an enclosed room to a mixing chamber and by mixing the portion of ambient air of the enclosed room with fresh air in the mixing chamber;

(b) flowing the initial gas mixture provided in step (a) to a gas separation system comprising a nitrogen generator;

(c) separating at least a portion of the oxygen from the initial gas mixture via the nitrogen generator, thereby producing a nitrogen-enriched gas mixture having a residual oxygen content; and (d) flowing the nitrogen-enriched gas mixture of the gas separation system having the residual oxygen content into the enclosed room, wherein the method further comprises the following steps:

(i) measuring an oxygen level of a spatial atmosphere of the enclosed room;

(ii) measuring the residual oxygen content of the nitrogen-enriched gas mixture at an outlet of the nitrogen generator;

(iii) controlling a composition of the initial gas mixture in step (a) by actuating valves based on the measurements of the oxygen level of the spatial atmosphere and the residual oxygen content of the nitrogen-enriched gas mixture.

7. The method according to claim 6, wherein an oxygen content of an output gas mixture of the mixing chamber is measured for at least one of:

continuously;

at predefined times; and upon predefined events.

8. The method according to claim 6, comprising:

removing, in response to the flowing step (d), ambient air from the enclosed room; and mixing, outside the enclosed room, the ambient air with fresh air.

9. The method according to claim 8, wherein the volume of the ambient air of the removing step is equivalent to the volume of the nitrogen-enriched gas mixture of the flowing step (d).

* * * * *